US005480147A

United States Patent [19]

Ethier et al.

[11] Patent Number: 5,480,147

[45] Date of Patent: Jan. 2, 1996

[54] BASKETBALL GAME ADJUSTMENT APPARATUS

[76] Inventors: Albert J. Ethier, 10616 Horley St.; Eric Schulz, 10421 Lesterford Ave., both of Downey, Calif. 90241

[21] Appl. No.: 386,805

[22] Filed: Feb. 6, 1995

[51] Int. Cl.[6] ..... A63F 7/20

[52] U.S. Cl. ..... 273/85 R; 273/1.5 R; 273/397

[58] Field of Search ..... 273/1.5 R, 85 R, 273/85 A, 85 B, 85 F, 397, 356, 357

[56] References Cited

U.S. PATENT DOCUMENTS

| | | | |
|---|---|---|---|
| 1,886,479 | 11/1932 | Greenan | 273/85 R |
| 2,421,220 | 5/1947 | Robinson, 2D et al. | 273/85 F |
| 2,433,224 | 12/1947 | Koci et al. | 273/85 F |
| 2,534,067 | 12/1950 | Rubin | 273/1.5 R |
| 2,735,682 | 2/1956 | Sweet | 273/1.5 R X |
| 2,893,734 | 7/1959 | Tarte, Jr. | 273/85 R |
| 4,480,833 | 11/1984 | Barcelow et al. | 273/85 B |
| 4,805,917 | 2/1989 | Cochran et al. | 273/397 |
| 5,066,006 | 11/1991 | Driska | 273/1.5 R |
| 5,100,133 | 3/1992 | Riviezzo et al. | 273/1.5 R |
| 5,294,913 | 3/1994 | Mower et al. | 273/1.5 R X |

*Primary Examiner*—Paul E. Shapiro
*Attorney, Agent, or Firm*—Albert O. Cota

[57] ABSTRACT

An arcade basketball game which has a transparent enclosure (20) with basketball hoops (40) and a miniature basketball (28) inside. A pair of inclined playing surfaces (30) join together in a peak with transparent vertical barrier (34) on top, allowing the ball to roll to the lowest point where a striker bar (36) impedes its travel. An open space between the bar and the playing surface allow a hand held striker (52) to hit the ball upward at an angle toward the opposite players hoop in an attempt to score a goal. A shot blocker (70) and a pair of tip in hands (78) that are electrically controlled by a joystick (76) and hand switches (86) move in order to help or hinder the flight path of the ball. A game time display (60) indicates elapsed time and a pair of scoreboards (68) denote the scores of each player.

20 Claims, 4 Drawing Sheets

BASKETBALL GAME ADJUSTMENT APPARATUS

TECHNICAL FIELD

The present invention pertains in general to arcade type amusement game apparatus, and more specifically to a self contained, enclosed basketball game that employs a striker to shoot the ball into a hoop.

BACKGROUND ART

Previously many types of basketball oriented amusement games have been produced, some for home use and others for commercial arcades. The games require some type of equipment as basketball itself is played on a flat floor with a pair of backboards having a hoop through which the ball passes to makes a goal. Obviously, an amusement park or arcade requires miniature equipment and must include at a minimum, a basketball with some means of shooting it through the hoop. In most prior art a small ball is held by hand and thrown into the hoop at a distance. The distance required for this procedure is limited by the size of the arcade and in most cases it is restricted to have the ball thrown by hand unless the equipment is very large. Propelling arms or conduits for directing the balls travel have been used however, the ball is still manipulated by hand and subject to loss or theft.

A search of the prior art did not disclose any patents that read directly on the claims of the instant invention, however the following U.S. patents are considered related:

| U.S. Pat. No. | INVENTOR | ISSUED |
|---|---|---|
| 5,228,691 | McAlley | 20 July 1993 |
| 5,133,546 | Matherne et al | 28 July 1992 |
| 5,074,552 | Gomez et al | 24 December 1991 |
| 5,072,947 | Blue | 17 December 1991 |
| 4,210,328 | Meintzer et al | 1 July 1980 |
| 3,992,006 | Barlow | 16 November 1976 |
| 3,689,069 | Rogers | 5 September 1972 |

McAlley in U.S. Pat. No. 5,228,691 teaches a basketball game that employs a conduit through which the ball is thrown. The velocity of the throw is the predetermining factor for a goal to be made. Three conduits return the ball to a specific location relative to the accuracy of the slot permitting scoring of the game.

Matherne et al in U.S. Pat. No. 5,133,546 discloses an apparatus consisting of a foldable framework holding a see-through netting with a single backboard with a pair of hoops mounted thereon. A small basketball is thrown by hand toward the hoop and is returned to the player by the netting forming an inclined chute.

Gomez et al in U.S. Pat. No. 5,074,552 utilizes a backboard with a hoop that rotates about an axis over a range of positions to present the player with a variety of angles from which to make the throw. A framework holds conforming walls and a tilted floor to return the ball to the player. The ball is thrown by hand.

Blue's U.S. Pat. No. 5,072,947 is for a combined recreational game using a foam game ball with air holes and a paddle or racquet. A number of basketball hoops are mounted on backboards held in place by P.V.C. pipe.

Meintzer al in U.S. Pat. No. 4,210,328 employs a flat rectangular game board having basketball markings printed on the surface and is folded upward into an open box like structure. A small ball is tossed into the structure and bounced on the base and wall in an attempt to go through the hoops mounted at each end.

Rogers in U.S. Pat. No. 3,689,069 teaches a hard smooth playing board on legs in a box like configuration with basketball hoops on each end. The board is marked as a miniature court. The ball is thrown or bounced into the basket or hoop and remains on the playing board if the player exercises the necessary skill.

For background purposes and as indicative of the art to which the invention relates referenced may be made to the patent issued to Barlow in U.S. Pat. No. 3,992,006.

DISCLOSURE OF THE INVENTION

In the past many games capable of being used in arcades or amusement establishments that duplicate the game of basketball. These games attempt to use the players skill in throwing, shooting or bouncing a ball from a hard surface through a hoop mounted on a backboard. The actual skill of the game requires the use of a regulation ball having a given diameter and weight and when the "feel" is lost by reducing the ball in these parameters, the skill factor is also lost almost completely. Further, if the game cannot be duplicated in miniature some different muscular competence must replace this throwing ability. It is therefore a primary object of the invention to utilize a weighted implement in the form of a striker, having an angular impact surface, to hit the ball and send it toward the hoop. This movement of sliding the striker on an inclined surface and impacting the ball requires an entirely different type of muscular coordination with an accompanying skill much like billiards or other games using sticks, mallets or racquets. Further, this skill may be mastered by anyone of varying physical stature and adds to the intrigue and challenge of the game.

One of the problems of a unattended arcade or game apparatus located away from constant surveillance, is that parts of the game that are unattached may be lost or stolen. This occurrence is particularly evident where a ball having some value is concerned. It is therefore an important object of the invention to completely enclose the ball in the structure while having it visible at all times. This is accomplished by the utilization of transparent material for the vertical walls and ends of the enclosure. The material which preferably consists of shatter resistant clear acrylic plastic, accomplishes this object with safety and security.

Another object of the invention is the ability of the game apparatus to permit the player or players to use offensive and defensive strategies. This is accomplished by the use of ancillary shot blockers in the form of a paddle like member attached directly above each hoop. The opponent may "block the shot" with this device that is controlled by a joystick and swings unidirectionally as desired. The shooting player on the other hand may assist the ball to go into the hoop with a "tip-in hand" in the actual shape of a hand attached to an arm hanging from above. The tip-in hand is energized to move toward the hoop using switches that are positioned near the player. When two persons are playing, each may use different tactics and skills learned in games such as billiards, croquet, soccer, racketball etc.

Still another object of the invention is directed toward competition and simulation of some of the basketball game rules. The invention includes a score board, one at each end, to visually display the number of goals made by each player. Further, a game clock is located in the middle of the enclosure indicating the time remaining for the game and the time left before a shot must be made. A buzzer indicates time has run out for the shot and a no basket is indicated if a shot fails. Each player is visually aware of the status of the game adding to its competitiveness.

Yet another object of the invention permits the game to be played by a single person. In the event that only one player is using the invention, the ball is returned automatically to the players side through a pair of trapdoors located in the inclined-playing surface and the scores indicate for the home player only.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment. The preferred embodiment, as shown in FIGS. 1 through 12 is comprised of a substantially transparent enclosure 20 rectangular in shape and high enough for a player to see directly into the interior. The structure may be made of any material such as square, rectangular or round metal joined into a structural framework. Aluminum tubing or extrusions which are preferred, are attached together by welding or threaded fasteners. Steel, wood, fiberglass or structural plastic may also be used with equal ease.

Figure 1:
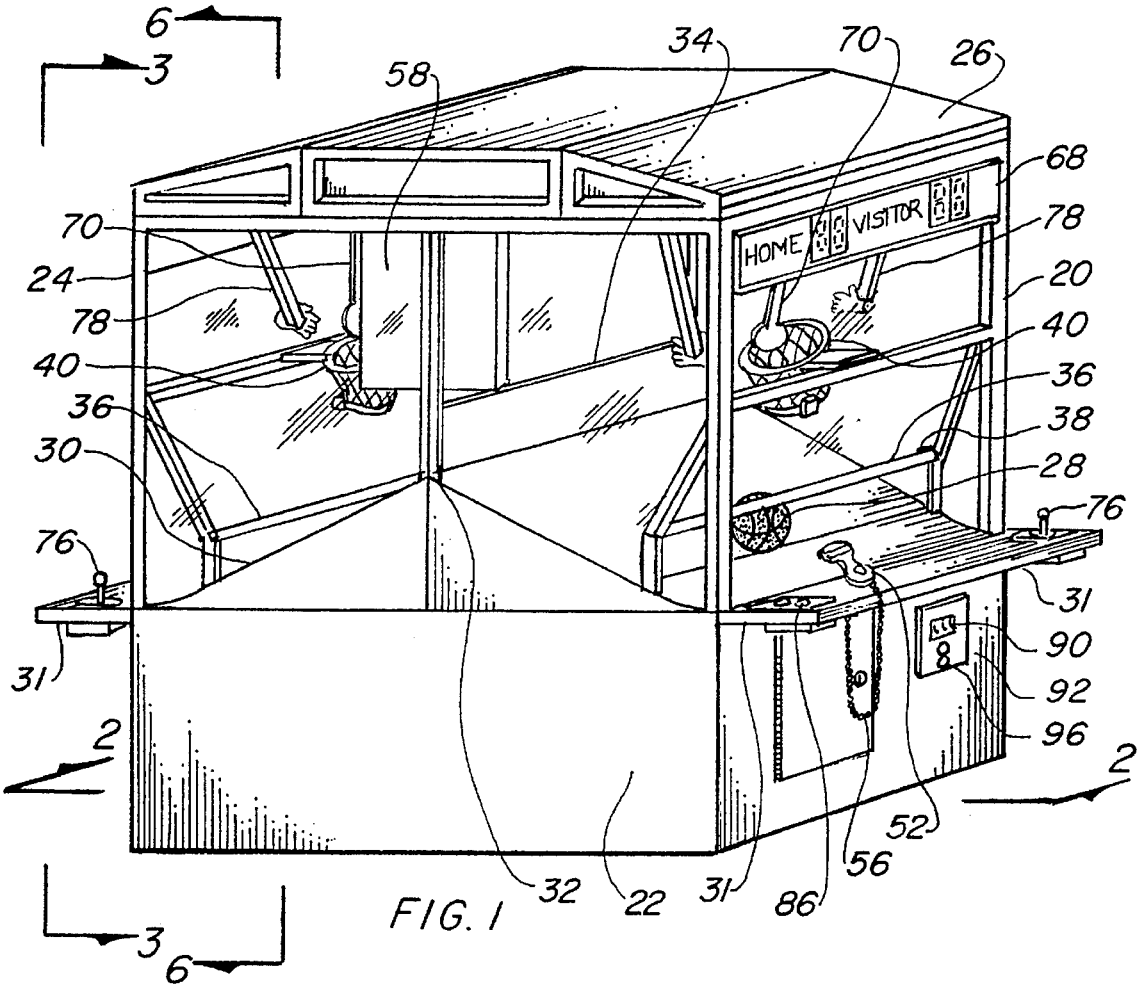
FIG. 1 is a partial isometric view of the preferred embodiment.
Figure 3:
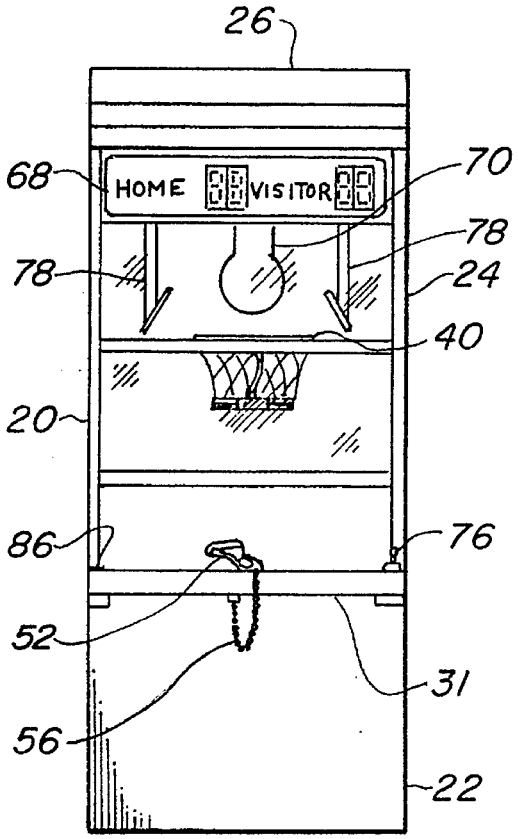
FIG. 3 is a right side view of the preferred embodiment.
Figure 4:
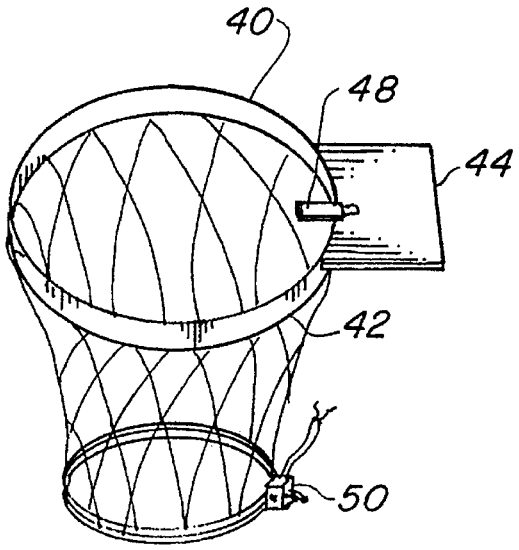
FIG. 4 is a partial isometric view of the basketball hoop with its accompanying lever switch and electrically actuated drawstring completely removed from the invention for clarity.
Figure 9:
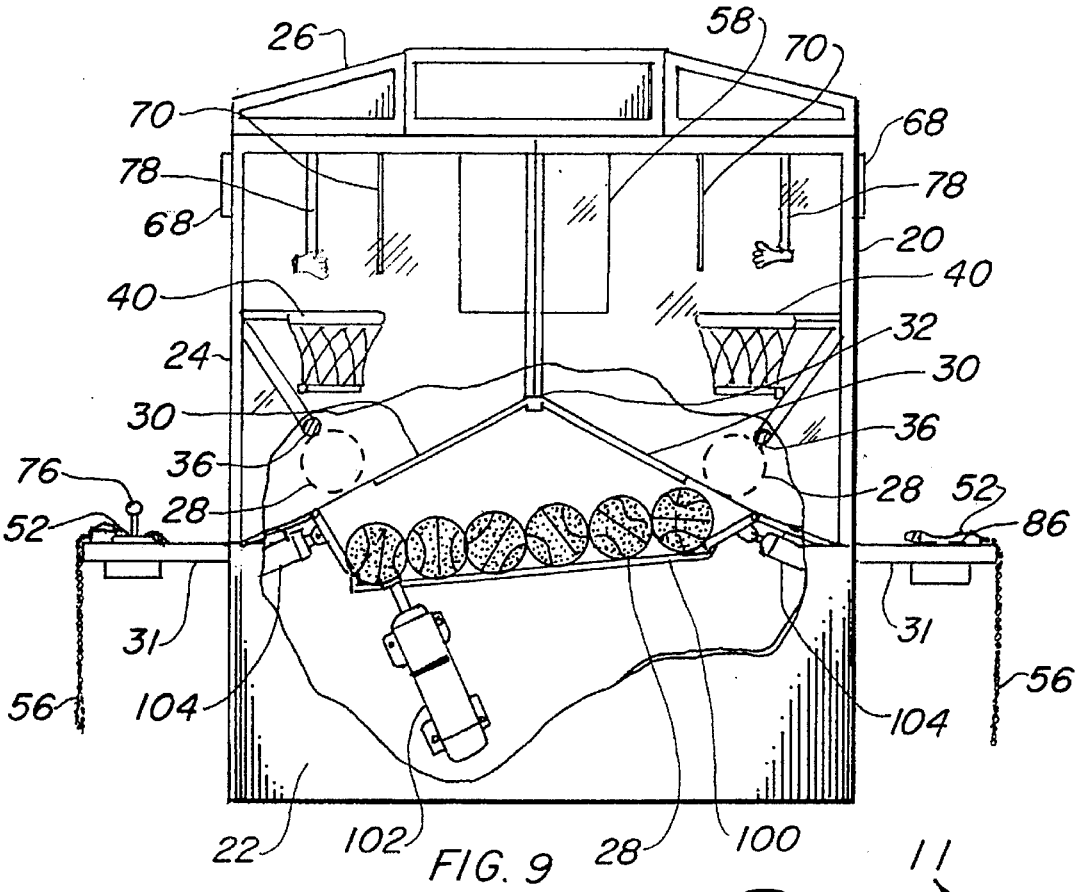
FIG. 9 is a elevational view of the cut away to depict the single player trapdoors and inclined ball retaining ramp.
Figure 10:
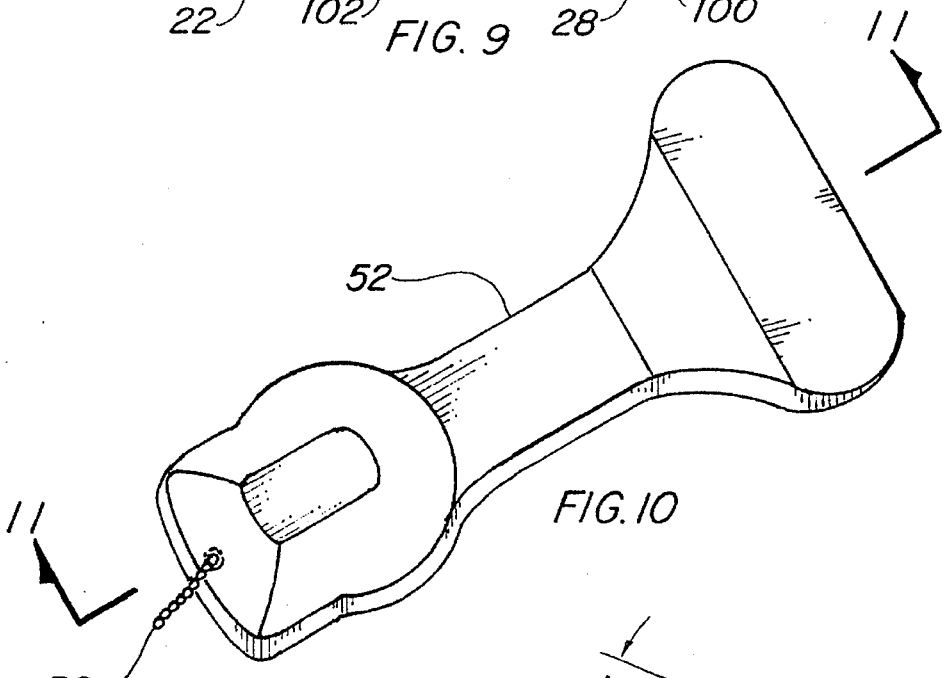
FIG. 10 is a partial isometric view of the striker completely removed from the invention for clarity.
Figure 11:
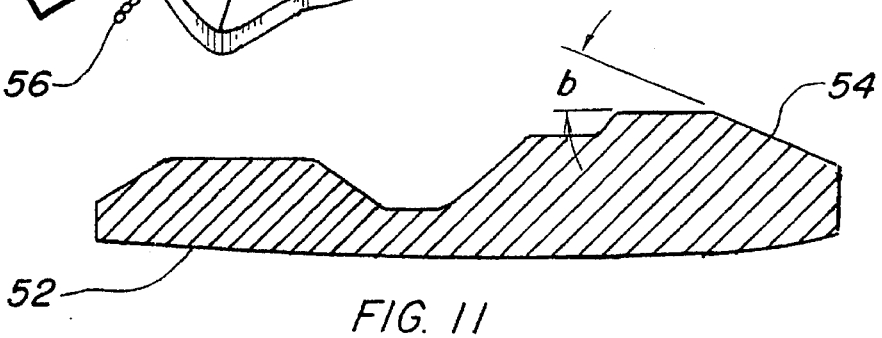
FIG. 11 is a cross sectional view taken along lines 11—11 of FIG. 10 with the angle of the striker designated with the letter "b".

The framework of the structure 20 is covered on the lower portion 22, below the players waist, with an opaque material such as sheet metal, wood, fiberglass, composition board, plastic or the like as the equipment inside need not be visible from the outside. The upper portion 24 however, must be viewed by the player in order to see the movement of the game ball. A clear shatter resistant acrylic plastic is ideal for the application however, clear polycarbonate, nylon, cellulose acetate, polyethylene, polypropylene or polyvinyl chloride may also be used as well as shatterproof glass. The roof 26 of the enclosure 20 may be opaque and of a material similar to the lower portion 22. FIGS. 1, 3 and 9 best depict this enclosure from a isometric, end and elevational view.

A miniature air inflated basketball 28 captivated inside the transparent portion of the enclosure 20. The basketball 28 is round, hollow and filled with pressurized air. The exterior surface of the ball contains seams and a pebble finish duplicating a regulation basketball except 40 to 70 percent smaller in diameter and weight.

Figure 2:
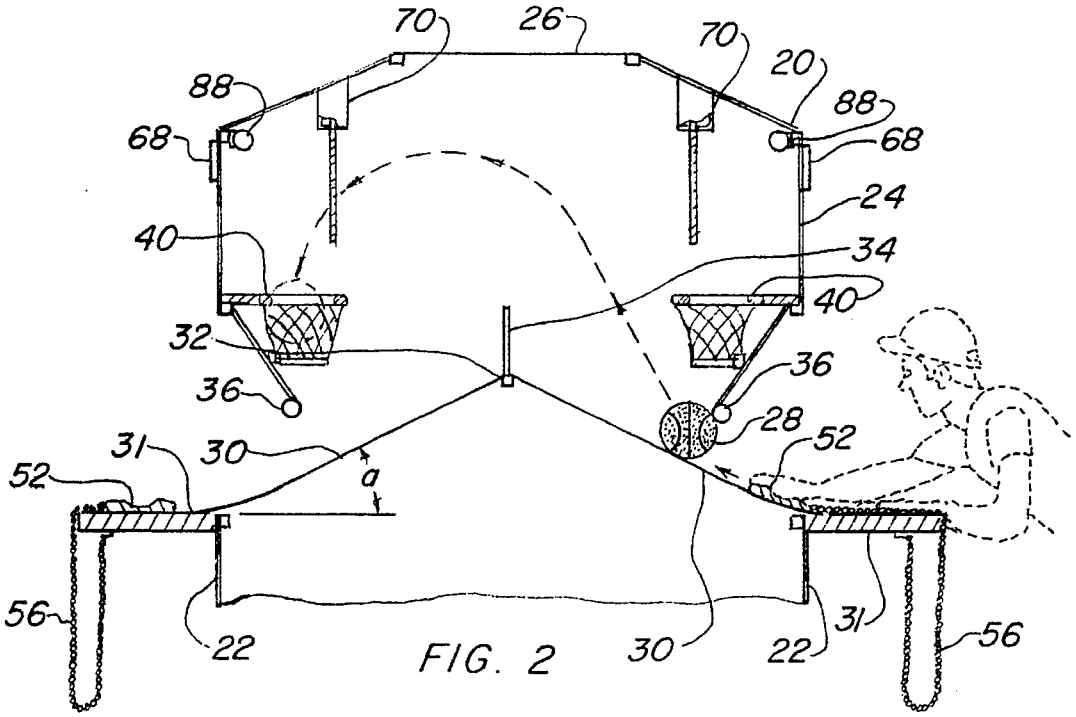
FIG. 2 is a cross sectional view taken along lines 2—2 of FIG. 1 illustrating the movement of the basketball in dotted lines when hit by the striker and the angle of the playing surface designated with the letter "a".

A pair of inclined playing surfaces 30 are positioned within the enclosure and are angled upwardly on a facing end, and are joined together to form a centrally located apex 32. FIG. 2 best shows this relationship and its obvious purpose to provide a downward positioning of the basketball 28 when at rest.

The playing surfaces 30 have an angle that can range from between 5 degrees to 15 degrees from horizontal, This angle as shown FIG. 2 and designated by the letter "a" allows the basketball to roll downwardly and to position it correctly for a shot. Each playing surface 30 continues from the angle "a" to a horizontal section protruding outwardly from the enclosure forming an extended shelf 31, The transition from angular to horizontal is radiused slightly to create a smooth gradation therebetween, A transparent vertical barrier 34 is upwardly connected to the apex 32 of the playing surface 30 creating a restrictive obstruction within the enclosure 20. The purpose of this barrier 34 is to assure that the basketball 28 will come to rest on the side opposite the shooting player and as a barricade to block the ball from a shot too low or slow to have any chance for a goal.

A striker bar 36 is located directly above each playing surface 30 somewhat inward from the outside end of the enclosure 20. Each bar 36 is positioned less than the basketballs heights in order that the basketball 28 is contained within the enclosure 20 when at rest. Further, this particular location permits exterior access to the ball as it rests between the bar 36 and playing surface 30. Each bar 36 is preferably round and has a diameter sufficiently large to prevent wedging of the ball between the bar 36 and playing surface 30. It has been found that 1.00 inch (2.54 cm) diameter is sufficient to accomplish this function. Each bar 36 further contains a pressure sensitive switch 38 that is positioned longitudinally along the bar. The switch is responsive to the presence of the basketball 28 at rest when it actually touches the bar. This switch 38 is necessary to input the event for the logic of the control system.

A pair of opposed basketball hoops 40 are located above the playing surfaces 30, as depicted in FIGS. 1 and 2. These hoops 40 are visible in full view from outside of the enclosure and are similar to regulation hoops only smaller. A hoop 40 is shown removed from the invention for clarity in FIG. 4 and consists of a round ring 42, with a horizontal attaching bracket 44, a fabric net 46 and a lever switch 48 positioned adjacent to the ring. During a game when the basketball 28 enters the hoop 40 the lever switch is activated signaling the control logic that a goal has been made. Each hoop 40 also contains an electrically actuated drawstring 50 with an encompassing member on the nets lower periphery retaining the basketball 28 within the net 46 when the game is over. This action accomplishes the purpose by reducing the size of the net when the encompassing member of the drawstring 50 is retracted.

A striker 52 is accessible from the outside of the enclosure 20 permitting a player to strike the resting basketball 28 toward the opponents hoop 40 and if actually passing therethrough scoring a goal. The striker 52 is depicted in FIGS. 1 and 3 also by itself in FIGS. 10 and 11. The striker 52 has an angular impact surface 54 that can range from 25 degrees to 35 degrees from horizontal as depicted by "b" in FIG. 11. The striker is shaped to fit the players hand and create a natural feel assisting the player's accuracy and permitting the player to exert the proper amount of force when hitting the ball. The bottom of the striker 52 is slightly radiused to match the curvature of the playing surface 30 at the transition of the horizontal shelf 31. A flexible retainer 56 connects the striker 52 to the shelf 31 of the playing surface 30 to prevent misplacing or theft when the apparatus is left unattended. The retainer 56 may be in the form of a link, jack, loop, plumbers, sash or ball chain alternatively a cable or other flexible material may also be used with equal utility. FIG. 2 depicts this retainer and its preferred connection points.

Figure 5:
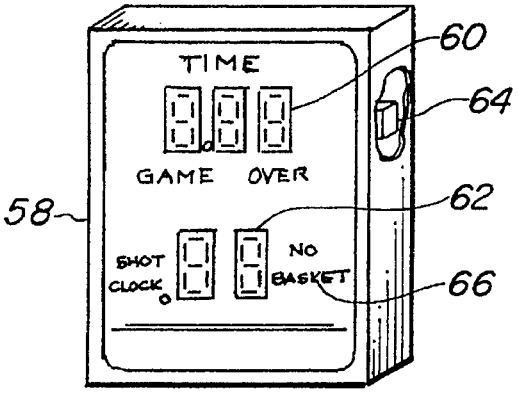
FIG. 5 is a partial isometric view of the game clock completely removed from the invention for clarity.

Time indicating means in the form of a time indicating panel 58 is attached within the enclosure 20 visible to players on opposed ends of the invention. This device visually and audibly indicates the time remaining in a game and the time allowed before each shot has to be made. The display on the panel 58 includes a game time display 60, a shot time display 62, an audible buzzer 64 that is energized when the time before a shot must be taken is exceeded, and a no basket visual display 66. When a score is not made by a player when the basketball 28 is shot from the playing surface 30 the "no basket" display 66 illuminates. FIG. 1 illustrates the preferred physical location of the panel 58 and FIG. 5 depicts the panel by itself with its markings, 4 inch×2 inch (10 cm×5 cm) 7 segment readouts are preferred and 24 seconds for a shot is favored.

A pair of scoreboards 68 are fastened to the enclosure 20 on opposite ends directly above the shelf 31 of the playing surface 30 indicating each players score. FIG. 1 illustrates the scoreboards 68 location and the readouts are preferably the same as the time display 60.

Figure 6:
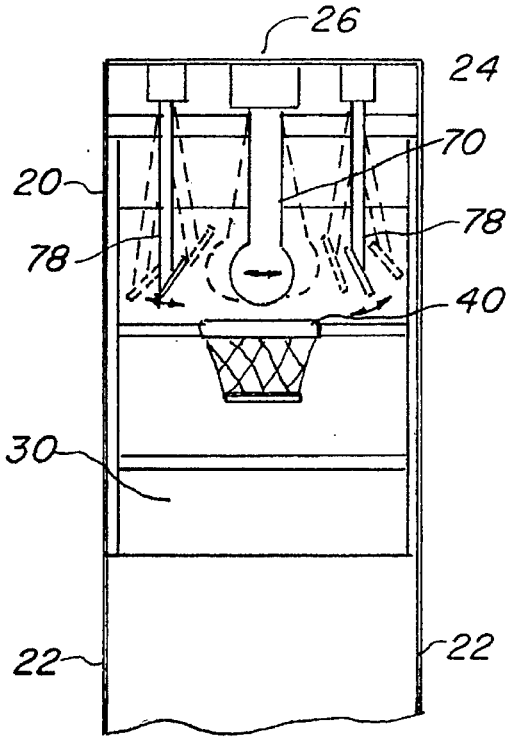
FIG. 6 is a cross sectional view taken along lines 6—6 of FIG. 1 illustrating the shot blocker and tip-in hands with their accompanying movement dotted.
Figure 7:
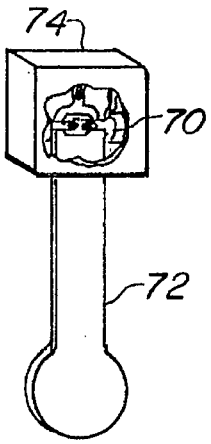
FIG. 7 is a partial isometric shot blocker completely removed from the invention for clarity.
Figure 8:
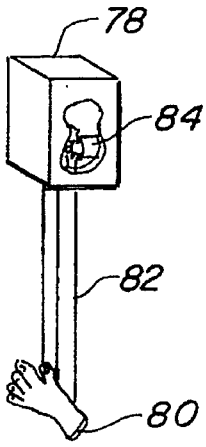
FIG. 8 is a partial isometric view of the tip in hand completely removed from the invention for clarity.

In order to allow defensive tactics to be utilized in the game, a shot blocker 70 is positioned within the enclosure as depicted in FIGS. 1 and 6. Each blocker 70 is attached to the inside of the roof in front of a hoop 40 and has a paddle member 72, complete with actuator 74, to move the paddle around in front of the hoop. A joystick 76 is positioned on the shelf 31 of the playing surface 30 to manually control the movement of the paddles 72 for shot blocking by the shooters opponent using an analog or digital electrical circuit.

The offensive tactics are provided by a pair of tip-in hands 78 attached within the enclosure 20 one on each side of each hoop 40. The hand 78 has a hand shaped member 80 attached to a vertical arm 82 and an arm actuator 84 to move the hand toward the hoop 40 to assist the ball to go into the hoop for a score. A pair of manually operated tip in hand switches 86 are located on the shelf 31 of the playing surface 30 to control the movement of the hand 78 to facilitate a goal by the shooting player.

In order to illuminate the inside of the enclosure 20, a number of interior lights 88 are positioned inside, in a location protected from the basketball 28 such as a corner of the roof. Some lights may be continually energized and others turned on when the game starts or they may all be lit continuously.

A coin actuated switch means initiates the game by a player depositing a predetermined number of coins in a coin actuator 90 that recognizes the proper coin and combination. When the actuator 90 accepts the coin or coins, an integral set of electrical contact points close, energizing the game logic. A coin collecting box integral with the actuator 88 accumulates the coins and a set of game selection start switches 90 electrically close and commence operation of the apparatus.

Figure 12:
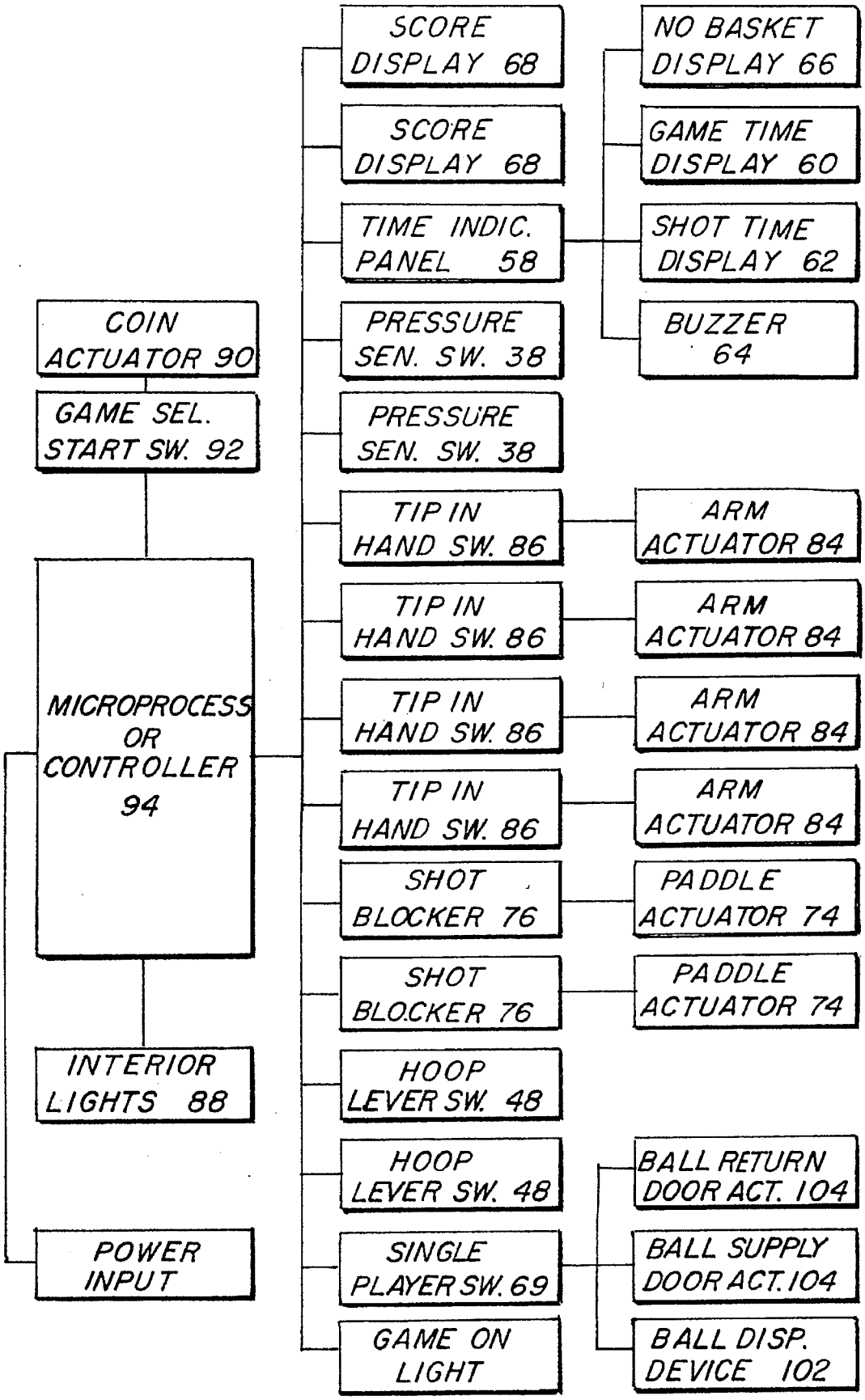
FIG. 12 is a block diagram of the electrical control system and its interrelationship.

A microprocessor controller 94, complete with analog and/or digital input and outputs, provides the logic control for the invention and is well known in the art. This logic includes starting, stopping, visual display, scoring, timing lighting, audible signals, etc. FIG. 12 depicts in block diagram the electrical system with reference numerals in parenthesis for ease of identification.

Single player means permits a single player to operate the invention by himself. FIG. 9 depicts this optional feature which allows the basketball 28 to be shot and returned to the same side. This feature is accomplished by the use of a single player selector switch 96 to initiate the game. When a shot is made and the ball travels to the opposite side of the enclosure, a trapdoor 98 opens in each playing surface 30 and the ball drops onto an inclined ball retaining ramp 100. The ramp 100 retains a number of basketballs 28 and a replacement ball is thrust upward to the waiting player by a ball dispensing device 102 such as a solenoid, servomotor, gear actuator or the like. Each trapdoor 98 is controlled by a electric door actuator 104 connected to each door in like form as the ball dispensing device 102. While a solenoid is depicted, other electrically driven actuators will function satisfactorily. When the new ball is pushed upward, both trapdoors 98 close and the ball rolls to the intersection of the bar 36 and the playing surface 30 ready for the next shot. The game is played by the single player in the same manner and method of scoring except the defensive measures are not used.

The two player game is undertaken by one of the players inserting coins in the coin actuator 90 and selecting the appropriate game. The basketball 28 is released by the drawstring 50 in one of the hoops 40 dropping to the at rest position between the striker bar 36 and playing surface 30. The offensive player hits the ball with the striker 52 toward the opponents hoop 40 while the defender manipulates the shot blocker 70 with the joystick 76 in an attempt to block the ball. The shooter may assist the ball to pass through the hoop 40 by moving one or both of the tip in hands 78 using the hand switches 86. If the ball goes through the ring of the hoop 40, a goal is scored and the scoreboard 68 indicates the event. Each player has only a predetermined amount of time to shoot, preferably 24 seconds, and the shot time display 62 indicates the remaining time. If a shot is not made by then, the buzzer 64 sounds and the ball must be hit over to the other player. The game continues for the time duration established and the scores of both players are accumulated and displayed on the scoreboards 68 located on each side. The players develop skill in the amount of force and angle of the striker 52 and also the manipulation of the offensive and defensive movable members.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

We claim:

1. A basketball game amusement apparatus comprising:

a) a transparent enclosure permitting viewing therewithin, b) a miniature air inflated basketball captivated inside the enclosure, c) a pair of inclined playing surfaces within the enclosure each angled upwardly on a facing end forming a centrally located apex providing downward positioning of the basketball at rest, d) a pair of opposed striker bars each positioned less than the basketballs height directly above one of the playing surfaces such that the basketball is contained within the enclosure and yet accessible between the bar and the playing surface from outside, e) a pair of opposed basketball hoops above the playing surfaces in full view from outside the enclosure, and f) a striker having an angular impact surface, accessible from outside of the enclosure, permitting a player to hit the resting basketball with the striker toward the opponents hoop and when passing through scoring a goal.

2. The basketball game amusement apparatus as specified in claim 1 further comprising a transparent vertical barrier upwardly affixed to the apex of the inclined playing surfaces creating a restrictive obstruction within the enclosure, assisting the basketball to come to rest on a side opposite a shooting player.

3. The basketball game amusement apparatus as specified in claim 1 wherein said basketball further comprises a round hollow pneumatic ball having seams and a pebble like exterior surface duplicating a regulation basketball only from 40 to 70 percent smaller in diameter and weight.

4. The basketball game amusement apparatus as specified in claim 1 wherein said inclined playing surface further comprises an angle substantially from 5 degrees to 15 degrees from horizontal.

5. The basketball game amusement apparatus as specified in claim 1 wherein said striker bars further comprises a round configuration having a diameter sufficiently large to prevent wedging of the ball between the bar and the inclined playing surface.

6. The basketball game amusement apparatus as specified in claim 1 wherein said striker bars further comprises a pressure sensitive switch integral therewith that perceives the basketball at rest touching the bar.

7. The basketball game amusement apparatus as specified in claim 1 wherein said basketball hoops further comprises a round ring with a horizontal attaching bracket, a fabric net, and a lever switch positioned adjacent to the ring such that when the basketball enters the hoop, the lever switch is actuated.

8. The basketball game amusement apparatus as specified in claim 7 further comprising said basketball hoop net having an electrically actuated drawstring with an encompassing member on the nets periphery such that the basketball may be retained within the net when a game is over by a reduction of size of the net when the encompassing member on the net is retracted.

9. The basketball game amusement apparatus as specified in claim 1 wherein said striker further comprises an inclined angle on one end substantially from 25 degrees to 35 degrees from horizontal.

10. The basketball game amusement apparatus as specified in claim 1 further comprising a flexible retainer connecting said striker to said playing surface to prevent misplacing and theft when the apparatus is left unattended.

11. The basketball game amusement apparatus as specified in claim 1 further comprising time indicating means disposed within the enclosure, visible to players on opposed ends of the apparatus, to visually as well as audibly indicate time remaining in a game and time allowed before each shot must be made.

12. The basketball game amusement apparatus as specified in claim 11 wherein said time indicating means further comprises a time indicating panel characterized by a game time display, a shot time display, an audible buzzer energized when shot time has exceeded an allowable time duration, and a no basket visual display illuminated when no score was made by a player when the basketball was shot from the playing surface.

13. The basketball game amusement apparatus as specified in claim 1 further comprising a pair of scoreboards fastened to the enclosure on opposed ends directly above the playing surfaces, indicating a players score also an opponents score.

14. The basketball game amusement apparatus as specified in claim 1 further comprising a pair of shot blockers each attached within the enclosure directly above each hoop, each shot blocker further comprising a paddle member including a paddle actuator to move the paddle around in front of the basketball hoop, and a joystick positioned on an outwardly extending shelf portion of the playing surface to manually control paddle movement for shot blocking.

15. The basketball game amusement apparatus as specified in claim 1 further comprising a pair of tip in hands attached within the enclosure one on each side of each hoop, each hand further comprising a hand shaped member attached to a vertical arm, an arm actuator to move the hand toward the basketball hoop to assist the ball to go into the hoop for a score, and a pair of manually operated tip in hand switches located on an outwardly extending shelf portion of the playing surface to control movement of the hand for tip in of the basketball.

16. The basketball game amusement apparatus as specified in claim 1 further comprising a plurality of interior lights within the enclosure for inside illumination thereof.

17. The basketball game amusement apparatus as specified in claim 1 further comprising a coin actuated switch means for game initiation by a player depositing coins therewithin, energizing an electrical system for timing and scoring.

18. The basketball game amusement apparatus as specified in claim 17 wherein said switch means further comprises a coin actuator that recognizes a coin, collecting box for accumulating coins and an integral game selection start switch electrically commencing the amusement apparatus.

19. The basketball game amusement apparatus as specified in claim 1 further comprising a microprocessor controller having inputs and outputs, the controller providing logic control for the apparatus including, starting, stopping visual display and audible indication thereof.

20. The basketball game amusement apparatus as specified in claim 1 further comprising single player means, defined by:

a single player selector switch, a trapdoor in each inclined playing surface, permitting the basketball to drop below the playing surface, an electric door actuator connected to each trapdoor for opening and closing therewith, an inclined ball retaining ramp under each playing surface for rolling storing basketballs, and a ball dispensing device disposed under the ramp to elevate a basketball above the playing surface permitting player access therewith.

* * * * *